United States Patent [19]

Hilbert

[11] Patent Number: 5,025,287

[45] Date of Patent: Jun. 18, 1991

[54] DEVELOPMENT APPARATUS HAVING DUAL INTERLEAVING PADDLE MIXERS

[75] Inventor: Thomas K. Hilbert, Spencerport, N.Y.

[73] Assignee: Eastman Kodak Company, Rochester, N.Y.

[21] Appl. No.: 451,853

[22] Filed: Dec. 18, 1989

[51] Int. Cl.[5] ..... G03G 15/06; B01F 7/00

[52] U.S. Cl. ..... 355/245; 366/301

[58] Field of Search ..... 355/245, 259; 118/653, 118/657, 658; 366/301, 300

[56] References Cited

U.S. PATENT DOCUMENTS

| | | | |
|---|---|---|---|
| 3,730,487 | 5/1973 | Lund | 366/300 X |
| 3,941,357 | 3/1976 | Wurtz | 259/104 |
| 4,056,076 | 11/1977 | Smith | 118/653 |
| 4,172,712 | 10/1979 | Heller | 65/161 |
| 4,183,674 | 1/1980 | Sudo et al. | 366/300 X |
| 4,234,259 | 11/1980 | Wiedmann et al. | 366/81 |
| 4,278,355 | 7/1981 | Forberg | 366/300 |
| 4,324,483 | 4/1982 | Tagawa et al. | 118/658 X |
| 4,560,281 | 12/1985 | Harris et al. | 366/300 X |
| 4,633,807 | 1/1987 | Jacobs | 118/657 |
| 4,634,286 | 1/1987 | Pike | 366/320 |
| 4,707,107 | 11/1987 | Joseph | 355/253 |
| 4,731,632 | 3/1988 | Fukushima et al. | 355/251 |
| 4,791,735 | 12/1988 | Forberg | 366/300 X |
| 4,887,911 | 12/1989 | Miyaji | 355/245 X |

*Primary Examiner*—A. T. Grimley
*Assistant Examiner*—Nestor R. Ramirez
*Attorney, Agent, or Firm*—Tallam I. Nguti

[57] ABSTRACT

A development apparatus in an electrostatographic copier or printer includes a housing having two parallel, cylindrical side-by-side recessed sump sections partially forming and overlapping segment therebetween, and a pair of rotatable mixers having radially extending paddles that interleaf within the overlapping segment of the sump sections. The development apparatus as such is particularly capable of producing chopping, folding, end-to-end and side-to-side mixing and charging movement of developer material therein, in order to provide high and reliable quality image development.

17 Claims, 4 Drawing Sheets

DEVELOPMENT APPARATUS HAVING DUAL INTERLEAVING PADDLE MIXERS

BACKGROUND OF THE INVENTION

This invention relates to development apparatus in electrostatographic copiers and printers for electrostatically developing toner images in such copiers and printers with developer material consisting of charged carrier and toner particles. More particularly, this invention relates to such a development apparatus that produces high quality image development by significantly improving developer material movement, mixing and charging. It does so by preventing significant dusting in such apparatus, as well as, uneven accumulation and depletion of toner particles therein.

It is well known to use toner particles held at a development apparatus in electrostatographic copiers and printers to develop electrostatically formed latent images on an image-bearing member in such copiers and printers. The toner particles may be held alone or as a component of a two-component development material, the second component being magnetic carrier particles.

Typically, the development apparatus used is elongate, front-to-back, and is used to hold, move and mix the development material. Moving and mixing the developer material as such, triboelectrically and appropriately charges the toner and carrier particles therein. Additionally the development apparatus also brings the developer material into applying relationship with the images in the copier or printer to be developed with the charged toner particles of the developer material. Such development apparatus are disclosed, for example, in commonly assigned U.S. Pat. Nos. 4,633,807, 4,634,286, and 4,707,107.

The quality of images developed with toner particles as above, depends significantly on the effectiveness and reliability of the development apparatus in triboelectrically charging the toner and carrier particles, and in consistently maintaining higher concentration levels of toner particles from one end to the other within the elongate development apparatus. As such, the developer material moving and mixing devices of the development apparatus are therefore very important in any efforts at improvimg the quality and reliability of image development by such apparatus.

It has been found however that development apparatus including conventional developer material moving and mixing devices such as ribbon blenders, occasionally and unpredictably move or pump developer material unevenly within the sump portion of the development apparatus. Such uneven pumping or movement of developer material is often accompanied by excessive dusting within the development apparatus, by inadequate mixing and, hence, by inadequate charging of the toner and carrier particles therein. More importantly, such uneven movement or pumping of developer material results in uneven front-to-back accumulation and depletion of toner particles within the development apparatus. The end result, of course, is occasional poor and unreliable quality development of images.

These shortcomings of such conventional development apparatus have been found to be especially true when the developer material is of the type disclosed in commonly assigned U.S. Pat. No. 4,546,060 issued Oct. 8, 1985 in the names of Miskinis et al. Such developer material as disclosed is comprised of insulative toner particles and of carrier particles exhibiting hard magnetic properties.

SUMMARY OF THE INVENTION

It is, therefore, an object of the present invention to provide a development apparatus in an electrostatographic copier or printer that produces high and reliable quality image development.

It is another object of the present invention to provide such a development apparatus that achieves excellent side-to-side and end-to-end movement and mixing of developer material therein, and that thereby prevents significant dusting, uneven accumulation, and uneven depletion of the toner particles therein.

In accordance with the present invention, a development apparatus is provided for developing electrostatic latent images in an electrostatographic copier or printer with developer material consisting of charged toner particles and charged magnetic carrier particles. The development apparatus includes an elongate housing having a sump portion for holding, mixing and charging developer material, a development roller located in a top portion of the housing adjacent the image-bearing surface of the copier or printer for moving the charged developer material into applying relationship with the electrostatic latent images thereon thereby developing such images with toner particles, and feed means between the sump portion and the development roller for feeding charged developer material from the sump portion to the development roller. The sump portion of the development apparatus consists of first and second parallel, side-by-side cylindrical recessed sections that partially form an overlapping segment within the bottom of the housing.

The development apparatus further includes first and second rotatable mixing devices or mixers that are mounted side-by-side in the first and second recessed sump sections respectively. Each such mixing device or mixer includes a rotatable shaft, and an axially repeated set including first and second radially extending paddles attached at a developer material moving attack angle $X_0$ to the shaft. The first and second paddles of each set are spaced circumferentially an angle $Y_0$ about the shaft. The first and second mixers are mounted within the first and second recessed sump sections such that the radially extending paddles of the mixers interleave therebetween, within the center or overlapping segment of such sections.

As such, the first and second mixers can be rotated to produce desired developer material mixing and charging movement that includes a chopping action, a folding action, end-to-end flow, and side-to-side flow, thereby assuring high charge and uniform toner concentration levels, as well as, even end-to-end accumulation and depletion of toner particles therein.

BRIEF DESCRIPTION OF THE DRAWINGS

In the detailed description of the invention presented below, reference is made to the drawings, in which.

DETAILED DESCRIPTION OF THE PRESENT INVENTION

Figure 1A:
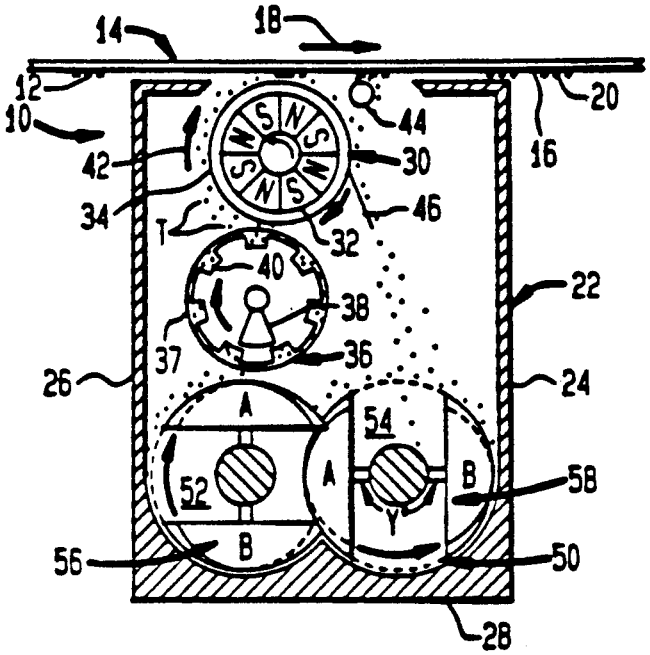
FIG. 1A is an elevational end view, partly in section, of the development apparatus of the present invention, including mixing devices having paddles that are aligned and spaced circumferentially an angle of 180°.
Figure 1B:
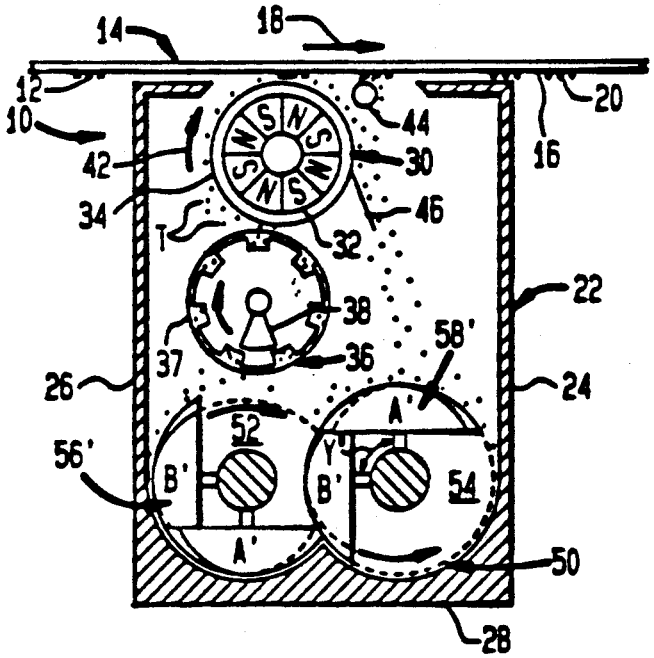
FIG. 1B is the same view of FIG. 1A, including mixing devices having paddles that are axially offset, and circumferentially spaced an angle of 90°.

Referring now to FIGS. 1A and 1B of the drawings, the development apparatus of the present invention is generally designated 10. The apparatus 10 is adapted to hold, mix and supply a quantity of marking particles, such as toner particles contained in magnetic developer material T, for developing latent electrostatographic images 12 on the image-bearing member 14 of an electrostatographic copier or printer. The image-bearing member 14 has an image-bearing surface 16 and can be an endless web, a drum or discrete sheets. In the copier or printer, the member 14 is moved, for example, in the direction shown by arrow 18 along a path past the development apparatus 10 such that charged toner particles in the magnetic development material T can be attracted to the electrostatic latent images 12, forming toner or developed images 20.

The development apparatus 10 has an elongate housing 22 which includes a top wall having an opening therein, upright end walls (not shown), side walls 24, 26 and a bottom wall 28. A magnetic development roller 30 located in the upper portion of housing 22 extends substantially the entire length (end wall-to-end wall) of the housing. The roller 30 is rotated within the housing 22 so that it is within the opening in the top wall, and so that it projects slightly therethrough. The development apparatus 10 is mounted within the copier or printer so that the roller 30 is adjacent and spaced only a small distance from the image-bearing surface 16 of the member 14. The development roller 30 preferably includes a magnetic core 32 consisting of a series of longitudinally extending, alternating pole magnets arranged as shown. The core 32 is rotatable and can be so driven, for example, in the counterclockwise direction as indicated, by a motor (not shown). The roller 30 also includes a non-magnetic shell 34 that may be concentric with the core 32, and that may be stationary or similarly may be rotatable as indicated.

The development apparatus 10 also includes a feed roller 36 located below the development roller 30 for feeding developer material T onto the surface of the non-magnetic shell 34. The feed roller 36 includes a stationary shell 37 and a stationary magnet 38 for attracting magnetic developer material thereinto through a first opening at the bottom thereof for movement mechanically therein by a rotatable fluted core 40. The developer material moved thus is attracted out of the feed roller 36 through another opening at the top thereof, and onto the surface of the shell 34 by the magnetic influence of the core 32. Rotation of the core 32 and shell 34 of the development roller 30, as above, will then move the developer material T attracted thereonto, in the direction of the arrow 42 for electrostatically developing the images 12 on the surface 16.

During such image development, appropriately charged toner particles, contained together with oppositely charged magnetic carrier particles in the developer material T being moved by the development roller 30, are desirably attracted onto the latent electrostatic images 12 on the surface 16 thereby forming the toner or developed images 20. The toner images 20 subsequently can be transferred, if necessary, onto a suitable receiver for fusing in order to form a fused copy thereof.

To improve the quality of such a fused copy, the development apparatus 10 includes a scavenging device 44 for recovering, from the image-bearing surface 16, any charged magnetic carrier particles undesirably also attracted to the latent images 12 during image development, as above. The apparatus 10 also includes a skive mechanism 46 for removing spent developer material from the development roller 30 before it again attracts fresh developer from the feed roller 36 for subsequent image development.

The quality of image development with charged toner particles, as above, depends even more significantly on a number of factors, including particularly the charge values or levels of the toner and carrier particles of the developer material T, as well as, on the level and uniformity of the concentration of such charged toner particles available throughout the elongate development apparatus. As is well known, these quality factors are directly determined by the ability and effectiveness of the development apparatus 10 (i) to cause desirable triboelectric charging of the toner and carrier particles by moving and mixing the developer material, and (ii) to achieve and maintain even front-to-back, and side-to-side movement, mixing, and accumulation of developer material within the sump portion thereof. Such ability and effectiveness of the development apparatus 10 should hold true even when, given the depletion of toner particles through image development, fresh toner particles are frequently added thereto, for example, to the center of the sump portion. Following such addition, the fresh toner particles must of course be quickly and effectively moved and mixed with the low toner concentration developer material therein, in order to quickly achieve desirable high and uniform toner particle charge and concentration levels throughout the elongate development apparatus. Such levels, as is well known, are very necessary for high and reliable quality image development.

Accordingly, for achieving such high and reliable quality image development, the development apparatus 10 includes a sump portion 50 consisting of a pair of side-by-side, parallel, recessed cylindrical sections 52 and 54 for holding a supply of developer material T. The apparatus 10 also includes a pair of rotatable first and second interleaving paddle mixing devices or mixers 56, 58, which relative to the bottom of the apparatus, are mounted therein side-by-side and parallel to each other, for moving, mixing and thereby triboelectrically charging the developer material T. The sump sections 52, 54 are located so that they partially form an overlapping segment therebetween. The first and second mixing devices or mixers 56, 58 additionally function to move the charged developer material T in the sump portion into transfer relationship with the feed roller 36, as well as, to remix spent developer removed from the surface of the development roller 30 by a skive 46.

Referring now to FIGS. 1A-3B, two functionally similar but structurally different embodiments of the mixing devices or mixers 56, 58; 56', 58', are illustrated. One embodiment is illustrated in FIGS. 1A, 2A, and 3A, and the other embodiment is similarly illustrated in FIGS. 1B, 2B and 3B. For each embodiment however, the first and second mixers are identical, except that when mounted for operation in the development apparatus 10, such first and second mixers are angularly offset or out of phase 90°. The reference numerals for the second embodiment are shown appropriately merely as primed forms of those of the first and related embodiment, and hence as, A', B', 56', 58', and so forth. The mixers of both embodiments are mounted the same way within the sump sections, and operate substantially in the same manner therein. Detailed description of the mounting and operation of one embodiment therefore also applies to the other. The structural similarities and differences are set forth below.

Each mixer 56, 58 includes a rotatable shaft 60, 62, respectively, and an axially repeated set 70 of first and second radially extending paddles A, B. Each paddle A, B consists of a small, thin plate segment b' attached to a short post member p' which is then connected to the shaft 60 or 62. The shafts 60, 62 are mounted within the first and second recessed sump sections 52, 54, respectively, so that the shafts are parallel to each other. As mounted, the shafts 60, 62 are geared together by a gear assembly 72. As such, the geared shafts 60, 62 can be driven synchronously in the directions of arrows 64, 66, respectively, as indicated, by means such as a drive motor M. Again shafts 60, 62 are mounted and angularly offset or out of phase $90_0$ with each other so as to prevent mechanical interference between their radially extending paddles A, B.

Figure 2A:
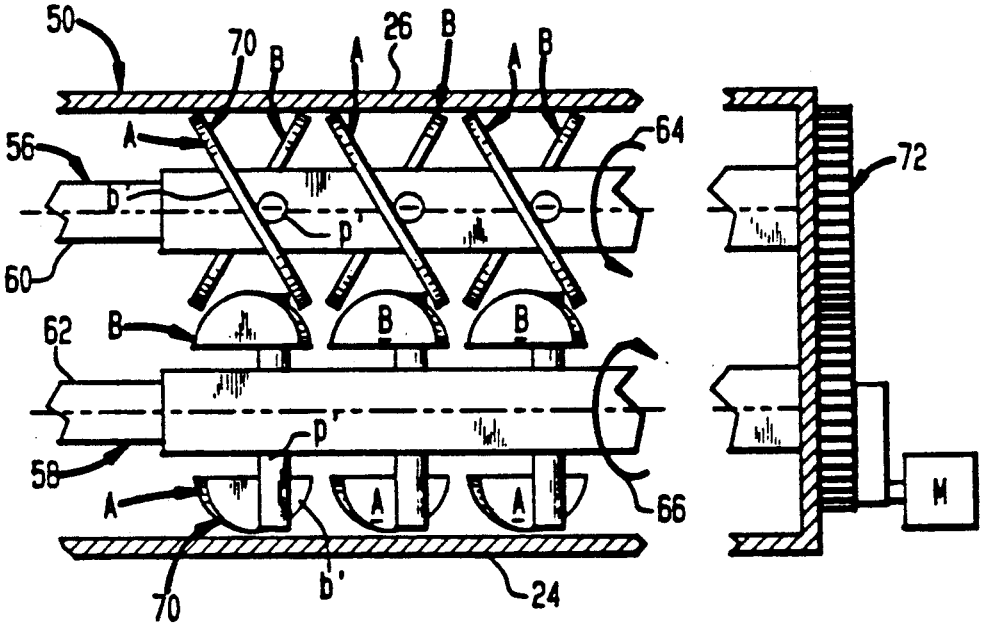
FIG. 2A is a fragmentary top view of the sump portion of the apparatus of FIG. 1A.
Figure 3A:
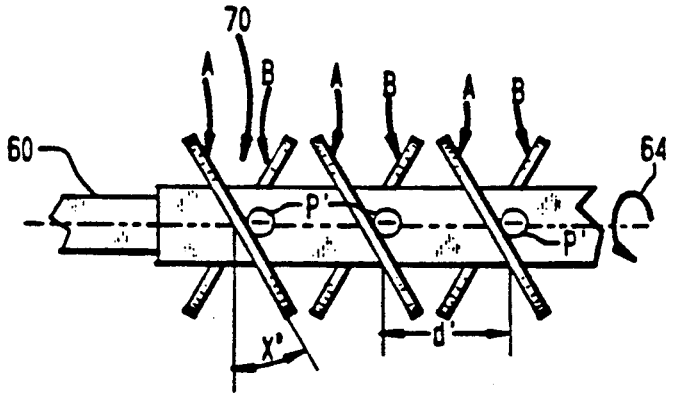
FIG. 3A is a fragmentary side view of a portion of the mixer of FIG. 1A.

Referring now to FIGS. 1A, 2A and 3A, the first and second paddles A, B of each identical mixer 56, 58, for example mixer 56, are connected to the shaft 60 so that the paddles A and B are diametrically opposite and aligned on the shaft 60, as well as, circumferentially spaced thereon an angle Y° equal to 180°. Additionally, each paddle is connected to the shaft 60 so that the paddle has a developer material moving attack angle X° less than normal (FIG. 3A), as measured relative to a plane normal to the axis of rotation of the shaft. The angle X° for example equals 30°. As shown, the paddles A and B, as such, form a set 70 that is repeated spaced a small distance d' along the axis of the shaft 60.

Figure 2B:
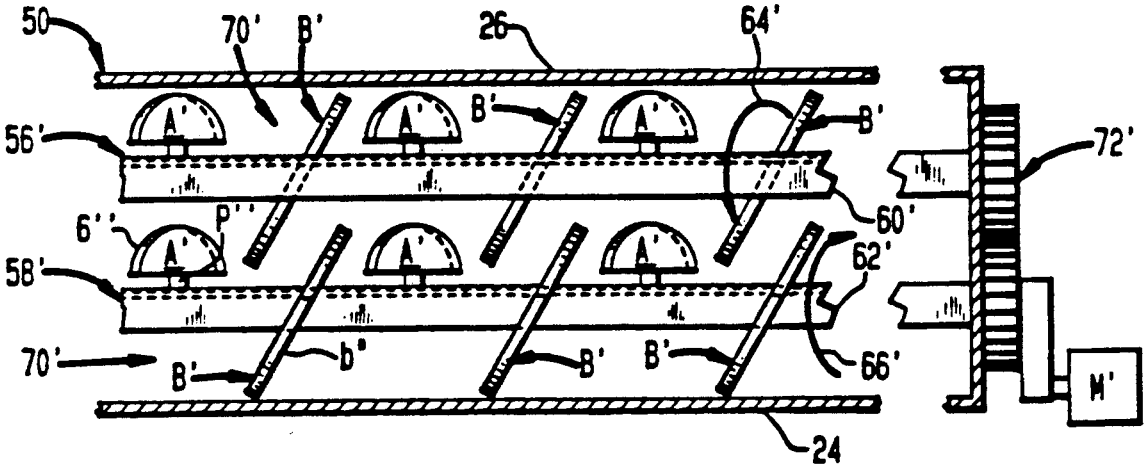
FIG. 2B is a fragmentary top view of the sump portion of the apparatus of FIG. 1B.
Figure 3B:
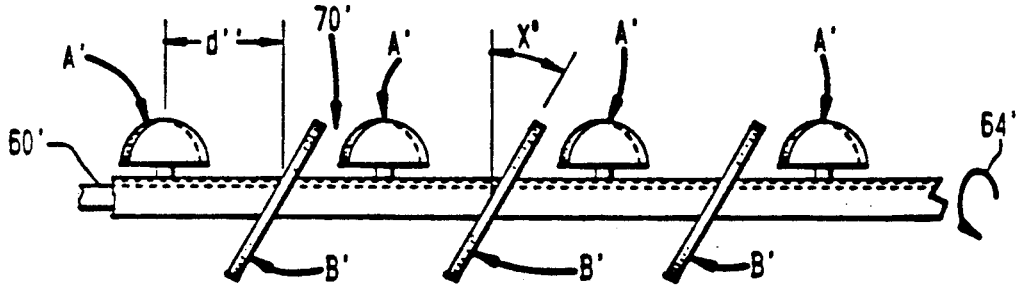
FIG. 3B is a fragmentary side view of a portion of the mixer of FIG. 1B.

Referring now to FIGS. 1B, 2B and 3B, the first and second paddles A', B' of each identical mixer 56', 58', for example mixer 56', are connected to the shaft 60' so that the paddles A' and B' are circumferentially spaced thereon an angle Y°, equal to 90° (complimentary angle of 270°, FIG. 1B), and so that the paddles are additionally offset or spaced axially a small distance equal to d''. The small distance d'' is preferably the same as the distance d' of the first embodiment. In the second embodiment, each paddle A' and B' is connected so that it too has a developer material moving attack angle X° less than normal (FIG. 3B), for example equal to 30° similarly measured. As shown, the paddles A' and B' also form a set 70' that is repeated along the axis of the shaft such that each paddle thereon is spaced the small distance d'' from an adjacent paddle.

When adapted for use in an elongate development apparatus suitable for developing 17''×11'' images, each mixer embodiment can have the following specifactions, which because they are the same are shown for the first embodiment. Thus the shafts 60, 62 can be 24 to 33 inches long, and have a diameter of about 0.313 of an inch. Each shaft can be drilled to receive the post members p'. Each such post can have a length of about 0.34 of an inch and a diameter of about 0.125 of an inch. The plate segment b' of the paddle can be circular, having a thickness of about 0.03 of an inch, and a radius of about 0.59 of an inch. The shaft, post and paddles of each mixer can be made of any suitable, non-magnetic material, such as stainless steel or plastic, for handling the magnetic developer material T.

Figure 4:
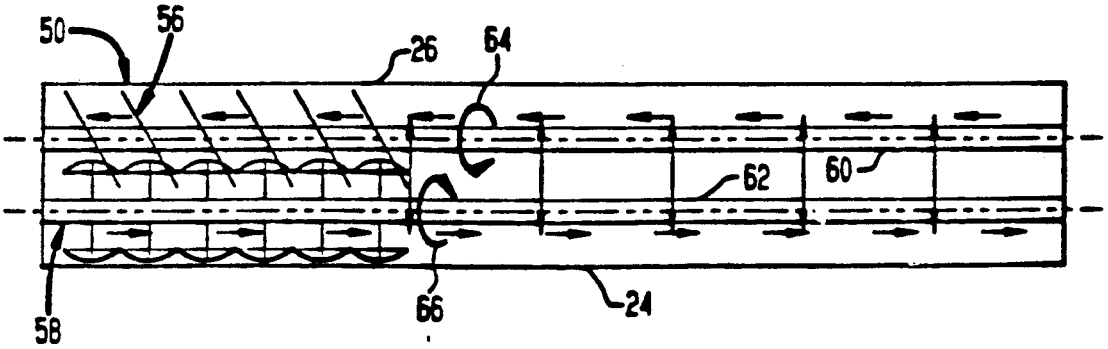
FIG. 4 is a schematic top view of the sump portion of the development of apparatus of the present invention showing the movement and mixing patterns of developer material therein.

Referring to FIGS. 2A and 4, the first and second mixers 56, 58, with the paddles A, B connected as above, are mounted within the sump sections 52, 54, as above, such that the paddles A, B of the first mixer 56 interleave therebetween, within the overlapping segment of the sections 52, 54, with the paddles A, B of the second mixer 58. FIG. 4 additionally includes a pattern of arrows illustrating the movement of developer material by either embodiment of the mixers 56, 58, as mounted within the sump portion 50 of the development apparatus 10 of the present invention. The same is true of the mixer of FIG. 2B.

As illustrated, the first and second mixers 56, 58 or 56', 58' of such the development apparatus 10 of the present invention, are particularly capable of producing end-to-end and side-to-side flow movement of developer material within the sump portion 50. Synchronous rotation of the first and second mixers, in the directions of the indicating arrows, respectively, additionally causes the plate segments of the paddles, connected and interleaving as above, to produce a chopping action by cutting into the end-to-end and side-to-side flowing developer material when interleaving as such, as well as, to produce a folding action by sweeping developer material up each side wall, over and down into the center, through the overlapping segment of the sump sections 52, 54. Such chopping and folding movements of the flowing developer material are particularly useful in preventing lumping and dusting of fresh new toner particles added to the development apparatus for mixing with toner depleted carrier particles therein. Such excellent end-to-end, side-to-side, and over, in, and out folding and chopping action by the mixers as mounted, produces excellent mixing, as well as, triboelectrically charges the toner and carrier particles of the development material.

Figure 5:
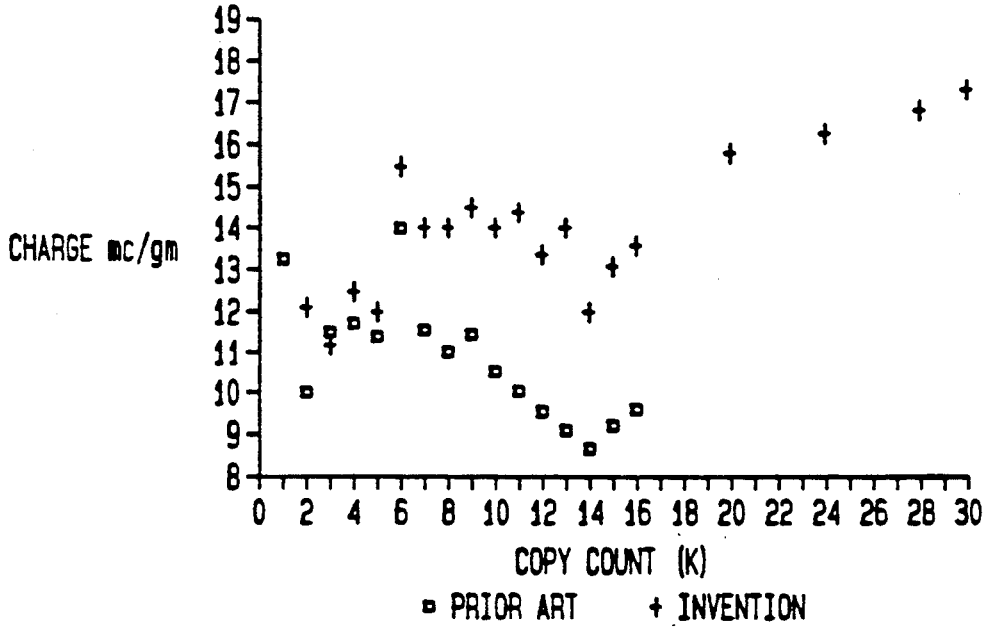
FIG. 5 is a comparative graph of developer material charge levels over a 30K (thirty thousand) copy run period of a comparable prior art development apparatus and of the present invention.
Figure 6:
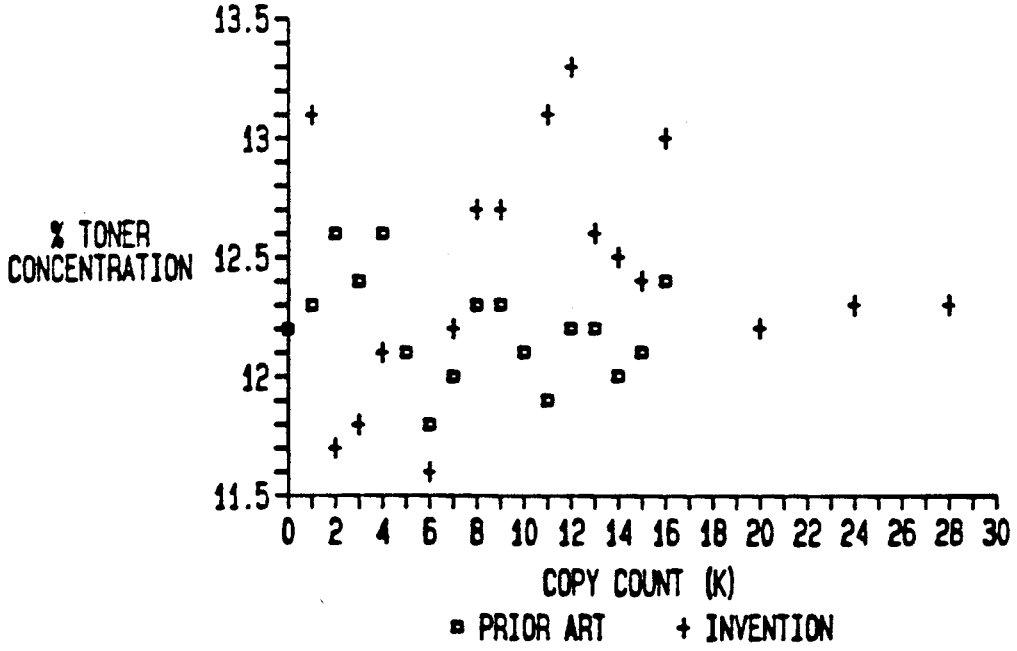
FIG. 6 is a comparative graph of toner concentration levels for the development apparatus of FIG. 5.

The results of charge levels (in microcoulombs/gram) and of toner concentration levels (as a percentage), for the development apparatus of the present invention, and for a comparable ribbon blender mixer type prior art development apparatus (both of which were subjected to the same operating duty cycle, toner throughput and other conditions), are shown comparatively in FIGS. 5 and 6. The developer material used in both cases was of the type disclosed in U.S. Pat. No. 4,546,060 consisting of insulative toner particles, and of carrier particles exhibiting hard magnetic characteristics.

In FIG. 5, it can be seen that while the development apparatus of the present invention maintained charge values consistently above 12 mc/gm over a run of 30K (thirty thousand) test copies, the prior art apparatus exhibited charge values that steadily decreased to values below 9 mc/gm. Additionally, the prior art apparatus failed after only about 16K (sixteen thousand) test copies, due to excessive dusting. The development apparatus of the present invention also out performed the comparable prior art apparatus with respect to toner concentration levels, as shown in FIG. 6. The end result for the development apparatus of the present invention was high and reliable quality image development over the 30K (thirty thousand) copy run.

Furthermore, in the development apparatus of the present invention, the excellent movement of the developer material which results in such excellent mixing and triboelectric charging of the particles therein, also assures against uneven accumulation of developer material within the sump portion, as well as, against uneven accumulation and depletion of toner particles throughout the length of the development apparatus. The chopping and folding actions of the interleaving paddles A and B also advantageously function to prevent significant dusting of the toner particles during such movements. The end result is high and reliable quality image development over significantly long copy runs.

Although the present invention has been described in detail with particular reference to preferred embodiments, it is understood that variations and modifications thereto can be effected within the scope and spirit of such invention.

I claim:

1. In an electrostatographic copier or printer a development apparatus for developing latent images on an image-bearing member of the copier or printer using developer material consisting of charged toner particles and charged magnetic carrier particles, the development apparatus including:

(a) an elongate housing having a sump portion for holding, mixing and charging developer material, said sump portion consisting of first and second parallel, side-by-side cylindrical recessed sections within the bottom of said housing, said first and second recessed sections partially forming an overlapping segment therebetween;

(b) a development roller located in a top portion of the housing to be adjacent the image-bearing member of the copier or printer for moving charged developer material into applying relationship with electrostatic latent images thereon, thereby developing such images with toner particles;

(c) feed means between said sump portion and said development roller for feeding charged developer material from said sump portion to said development roller; and (d) first and second mixers for producing developer material mixing and charging movement including a chopping action, a folding action, end-to-end flow, and side-to-side flow, thereby assuring high and reliable charge and toner concentration levels, as well as, even or uniform end-to-end accumulation and depletion of toner particles in the developer material, said first and second mixers each including:

(i) a rotatable shaft; and (ii) first and second radially extending paddles connected to said shaft and forming an axially repeated set on said shaft, said first and second paddles being each attached to a short post member and connected to said shaft at a developer material moving attack angle X° less than normal, as measured relative to the axis of rotation of said shaft, and said first and second paddles being spaced circumferentially on said shaft an angle Y°; and said first and second mixers being mounted side-by-side within said first and second recessed sections, respectively, of said sump portion such that said first and second paddles of said first mixer interleave within said overlapping segment of said recessed sections with said first and second paddles of said second mixer.

2. The development apparatus of claim 1 wherein said first and second mixers are geared together rotatably at one end for common driving.

3. The development apparatus of claim 1, wherein said first and second mixers are mounted for rotation within said sump portion angularly offset, and out of phase 90°.

4. The development apparatus of claim 1 wherein said shaft of said first mixer relative to the bottom of said apparatus, is mounted side-by-side and parallel to said shaft of said second mixer.

5. The development apparatus of claim 1 wherein each said first and second paddles of each said mixer consists of a small, thin plate segment of suitable material for moving magnetic developer material.

6. The development apparatus of claim 1 wherein said developer material moving attack angle X° is 30°.

7. The development apparatus of claim 1 wherein said angle Y° is 180°.

8. The development apparatus of claim 1 wherein said angle Y° is 90°.

9. The development apparatus of claim 1 wherein each said first and second paddles of each said mixer is connected to said shaft axially spaced a small distance from an adjacent paddle.

10. The development apparatus of claim 2 wherein said first and second mixers, as geared, are out of phase with each other, and are rotatably driveable synchronously so as to avoid mechanical interference between said interleaving paddles.

11. The development apparatus of claim 2 wherein said first and second mixers are counter-rotated so as to each move developer material up the respective adjacent side wall, and down the center, through said overlapping segment, in a chopping and folding manner.

12. A device for moving, mixing and charging developer material in the sump portion of a development apparatus in an electrostatographic copier or printer, the device including:

(a) a rotatable shaft mountable in said sump portion of the development apparatus;

(b) first and second radially extending paddles each consisting of a thin, small plate segment of a suitable material, and of a short post member connected thereto, said post members being connected to said shaft so as to form an axially repeated set of said first and second paddles thereon, said post members being connected such that each said paddle is spaced circumferentially thereon an angle Y°, and such that each said paddle has a developer material moving attack angle X° less than normal, as measured relative to the axis of rotation of said shaft.

13. The mixing device of claim 12 wherein said angle Y° is 90°.

14. The mixing device of claim 12 wherein said angle Y° is 180°.

15. The mixing device of claim 12 wherein said angle X° is 30°.

16. A device for moving, mixing and charging developer material in the sump portion of a development apparatus in an electrostatographic copier or printer, the device comprising first and second mixers, each said mixer including a shaft and radially extending paddles attached to said shaft each at a development material moving attack angle X° less than normal as measured relative to a plane normal to the axis of rotation of said shaft, each said paddle having a plate segment and a short post member, each said first and second mixers, relative to the bottom of said apparatus, being mounted side-by-side and parallel to each other, and having a spacing therebetween, and said paddles of said first mixer interleaving with said paddles of said second mixer within said spacing between said first and said second mixers.

17. In an elongate electrostatographic development apparatus having first and second ends, and first and second side walls, a method for charging, moving and feeding, to the development roller of such apparatus, a quantity of developer material consisting of toner particles and hard magnetic carrier particles having lumping or clumping characteristics, the method comprising the steps of:

(a) moving a first amount of the quantity of developer material within a first sump portion of the development apparatus down the center of the apparatus, up along the first side wall, and back to the center thereof, as well as simultaneously from the first end of the apparatus to the second end thereof using a first mixing device having a rotatable shaft and first and second radially extending paddles connected to said shaft and forming an axially repeated set on said shaft, said first and second paddles being connected to said shaft at a developer material moving attack angle X° less than normal, as measured relative to the axis of rotation of said shaft, and said first and second paddles being spaced circumferentially on said shaft an angle Y°;

(b) moving a second portion of the quantity of developer material in the development apparatus within a second sump portion thereof, forming an overlapping segment with said first sump portion, down the center of the apparatus, up along the second side wall, and back to the center thereof, as well as from the second end back to the first end thereof, using a second mixing device having a rotatable shaft and first and second radially extending paddles connected to said shaft and forming an axially repeated set on said shaft, said first and second paddles being connected to said shaft at a developer material moving attack angle X° less than normal, as measured relative to the axis of rotation of said shaft, and said first and second paddles being spaced circumferentially on said shaft an angle Y°, so as to uniformly mix and triboelectrically charge the toner and carrier particles comprising the developer material;

(c) interrupting the end-to-end flow of the developer material therein, by interleaving the first and second paddles of the first mixing device and the first and second paddles of the second mixing device, within the overlapping segment of the sump portions, in order to provide a chopping and/or cutting action, thereby preventing lumping or clumping of the hard magnetic carrier particles of the developer material; and (d) lifting and transferring the uniformly charged and mixed developer material from said first and second sump portions to a feed roller for feeding to the development roller.

* * * * *

UNITED STATES PATENT OFFICE

CERTIFICATE OF CORRECTION

Patent No. 5,025,287 Dated June 18, 1991

Inventor(s) Thomas K. Hilbert

It is certified that error appears in the above-identified patent and that said Letters Patent is hereby corrected as shown below:

| | |
|---|---|
| Claim 16, Col. 9, line 6 | After "each at a" change "development" to --developer-- |
| Claim 16, Col. 9, line 8 | After "relative to" delete --a plane normal to-- |

Signed and Sealed this

Twelfth Day of January, 1993

*Attest:*

DOUGLAS B. COMER

*Attesting Officer*

*Acting Commissioner of Patents and Trademarks*